US010118084B2

(12) United States Patent
Watry

(10) Patent No.: US 10,118,084 B2
(45) Date of Patent: Nov. 6, 2018

(54) ANTI-FATIGUE GRIP FOR POLES

(71) Applicant: Krissa Watry, Folly Beach, SC (US)

(72) Inventor: Krissa Watry, Folly Beach, SC (US)

(73) Assignee: Dynepic Sports, LLC, Charleston, SC (US)

( * ) Notice: Subject to any disclaimer, the term of this patent is extended or adjusted under 35 U.S.C. 154(b) by 0 days.

(21) Appl. No.: 15/210,719

(22) Filed: Jul. 14, 2016

(65) Prior Publication Data

US 2017/0296907 A1 Oct. 19, 2017
US 2018/0147477 A9 May 31, 2018

Related U.S. Application Data

(60) Continuation-in-part of application No. 15/098,801, filed on Apr. 14, 2016, which is a division of application No. 13/803,915, filed on May 6, 2013, now Pat. No. 9,370,685.

(51) Int. Cl.
*A63C 11/22* (2006.01)
*A45B 9/02* (2006.01)

(52) U.S. Cl.
CPC ..... *A63C 11/222* (2013.01); *A45B 9/02* (2013.01); *A45B 2009/025* (2013.01); *A45B 2200/055* (2013.01); *A63C 11/221* (2013.01); *Y10T 16/466* (2015.01)

(58) Field of Classification Search
CPC ..... A45B 9/02; A45B 2009/025; A45B 2200/055; A63C 11/222; Y10T 74/20828; Y10T 16/466; B62K 21/26; G05G 1/06
USPC ..... 135/76
See application file for complete search history.

(56) References Cited

U.S. PATENT DOCUMENTS 2,134,451 A 10/1938 Mogren
2,716,027 A 8/1955 Gehri
3,438,413 A * 4/1969 Borah ..... B25G 1/105 74/551.9
3,517,931 A 6/1970 Kalish
3,633,646 A 1/1972 Zilver
3,764,131 A 10/1973 Rooks
3,843,119 A 10/1974 Davis
3,995,650 A * 12/1976 DiVito ..... A61H 3/02 135/72
3,999,752 A 12/1976 Kupperman
4,060,240 A 11/1977 Dunston
4,109,907 A 8/1978 Zito
4,222,560 A 9/1980 Hallerman
4,339,138 A 7/1982 Di Manno
4,348,774 A 9/1982 Woodson
4,375,886 A 3/1983 Muys
4,466,309 A * 8/1984 Matey ..... A45B 9/02 16/421
4,563,002 A 1/1986 Jardine
4,784,391 A 11/1988 Herron
(Continued)

*Primary Examiner* — David R Dunn
*Assistant Examiner* — Danielle Jackson
(74) *Attorney, Agent, or Firm* — Gregory Finch; Finch Paolino, LLC

(57) ABSTRACT

The present disclosure presents a multi-purpose pole grip design in a generally conical shape to resist a user's hand from sliding off it while under axial loading. The present disclosure provides a more ergonomic and comfortable handle that requires less grip strength thus making it a prime design for poles used in sports like skiing and hiking and general walking sticks, including canes.

16 Claims, 12 Drawing Sheets

(56) References Cited

U.S. PATENT DOCUMENTS 4,867,444 A 9/1989 Castillo
4,941,232 A * 7/1990 Decker ..... B25F 5/006 16/421
4,974,836 A 12/1990 Hirsch
5,004,228 A 4/1991 Powers
5,076,570 A 12/1991 Davis
5,097,566 A * 3/1992 Decker ..... B25F 5/006 16/421
5,158,517 A 10/1992 Steggert
5,305,660 A * 4/1994 Hasegawa ..... B29C 33/00 16/441
5,341,758 A 8/1994 Strickland
5,423,536 A * 6/1995 Brown ..... A63B 53/14 473/300
5,423,730 A 6/1995 Hirsch
5,551,323 A * 9/1996 Beere ..... B25G 1/105 16/430
5,816,989 A 10/1998 Marcum
5,984,845 A 11/1999 Powers
6,017,279 A 1/2000 Sumitomo
6,692,415 B1 2/2004 Winston
6,692,416 B1 2/2004 Davis
6,960,144 B2 * 11/2005 Tucker, Sr. ..... A63B 49/08 473/513
7,740,570 B2 6/2010 Winston
7,896,783 B2 3/2011 Kessler
7,955,236 B2 6/2011 DiGiovanni
8,152,704 B2 4/2012 Brice
D782,272 S * 3/2017 Watry ..... D8/312
2003/0192395 A1 * 10/2003 Hsu ..... B62K 21/26 74/551.9
2004/0216550 A1 * 11/2004 Fallak ..... B62K 23/04 74/551.9
2005/0199089 A1 * 9/2005 Mangano ..... B62K 21/12 74/551.1
2008/0040891 A1 2/2008 Tyler
2010/0212453 A1 * 8/2010 Rouillard ..... B62K 21/26 74/551.9
2010/0292056 A1 11/2010 Birch
2014/0116196 A1 * 5/2014 Rogers ..... B62K 21/26 74/551.9
2014/0165336 A1 * 6/2014 Guyoton ..... A63C 11/222 16/430
2014/0329650 A1 * 11/2014 Watry ..... A63B 69/0093 482/139
2017/0274957 A1 * 9/2017 Krause ..... B62K 21/26

* cited by examiner

ANTI-FATIGUE GRIP FOR POLES

This patent application is a continuation-in-part of U.S. patent application Ser. No. 15/098,801 by Krissa Watry, filed on Apr. 14, 2016 and entitled "LOAD DISTRIBUTING GRIP HANDLE," assigned to the assignee of the present invention, which is a divisional of U.S. patent application Ser. No. 13/803,915 by Krissa Watry, filed on May 6, 2013 and entitled "LOAD DISTRIBUTING GRIP HANDLE," assigned to the assignee of the present invention.

FIELD

The present disclosure relates to a hand grip that more effectively locks the hand in place during sporting activities and walking. More particularly, the present disclosure relates to a hand grip for use on walking sticks, ski poles, snow shoeing, and various other athletic activities to reduce fatigue during the course of the activity.

BACKGROUND

Hand grips attached to poles for hiking, skiing, golfing, or even just for stability are used with varying degrees of comfort and utility.

One type of hand grip such as the grips on a hiking pole shown in FIG. 1 are not a desirable shape for optimum comfort. These grips include varying amounts of finger locating bumps and indentions in an effort to promote ergonomic design and comfort during use; however, they do little to secure the hand into place when the pole or stick strikes the ground and a load in the direction of the long axis of the pole is applied to the hand. Prior art ski poles, walking sticks, and canes have similar grips, and similar problems. Prior art designs require the user to tightly wrap their hand around the grip, which causes fatigue from the hand and forearm muscles being engaged. Additionally, this can be difficult when wearing the appropriate attire for the activity, e.g. ski gloves. Moreover, it is increasingly difficult to grasp these pole or cane grips when the user has conditions such as arthritis and cannot comfortably form a first around the grip. In addition to holding onto a pole grip similar to the prior art handle design in FIG. 1, prior art grips further require the user to maintain a firm squeezing force on the grip handle when the pole impacts the ground during the course of the activity. Different types of grip materials and grip surface designs can increase the coefficient of friction and help prevent the hand from slipping down the pole grip. The general equation (neglecting that the hand is not a solid body) for the force of friction equals the coefficient of friction for the two objects (hand and handle) multiplied by the force applied normal to the surface (hand squeezing force). Thus in addition to the coefficient of friction from the grip material and surface finish, the force of friction is a function of the load applied perpendicular to the grip handle surface (hand squeezing force). Any grip surfaces that can directly react the axial force will have a direct locking force. In the case of prior art, the force that locks the hand on the grip to prevent it from sliding downward is predominately the hand squeezing force and not the axial reaction force. This squeezing force causes hand and forearm fatigue which is not ideal for a number of reasons but especially when many of the activities using these grips are long duration activities on the order of hours, if not days.

In some instances, like the grip stop pictured in the prior art of FIG. 1 where the top of the pole grip aids in lifting the grip, a grip stop may be placed at the base of the handle and used to stop the hand from moving downward and relieving some of the squeezing force necessary to maintain the hand on the handle. This allows for some of the load from the pole striking the ground and carrying the users weight as an axial reaction force from the grip end stop versus relying solely on the force of friction. However, in the grip stop design, it applies the axial load through the small surface area of the pinky finger and base of the palm where it is in contact with the grip stop during the walking or skiing movement when the pole strikes the ground, making gripping uncomfortable for the user.

SUMMARY

It is an object of the present disclosure to provide a comfortable grip for poles that naturally locks a user's hand in place as a load is applied in the direction of the long axis of the pole. Embodiments of the present disclosure reduce the hand squeezing force required over prior art designs and distribute axial force over a larger surface of the hand, as compared to the prior art. Embodiments of the present disclosure thereby reduce fatigue on the hand and forearm during activity, thus creating an improved ergonomic, comfort grip for various activities performed with the grip installed on a pole or cane.

The shortcomings of the prior art are addressed by the innovation of the present disclosure featuring a cone shaped grip that maximizes the force down the center of the long axis of the pole grip (axial axis) that can be reacted by the user's hand by creating a shape of hand grip within the design constraints of proper handle design (bulk of material, length to fit common hand sizes, etc.) to allow the hand to be in a relaxed grip position, exerting minimal hand squeezing force, and yet being able to withstand the force applied axially through the pole when the pole is in contact with the ground. In an embodiment as a hiking pole, the axial load comes from the ground holding the user's weight and momentum, such that the hand does not slide down the pole handle. The present disclosure provides all the standard features of each pole handle to include safety straps, top grip-stop, and various integration techniques to attach the pole handle to the pole or stick, as required. The object of the present disclosure that is novel is the elements of the grip design itself to maximize grip comfort while reducing the loads exerted by the hand during the activity.

In the first aspect of the present disclosure, a uniquely shaped grip handle having many uses, especially attached to various types of poles—hiking sticks, ski poles, snow shoeing poles, canes, etc. The grip handle has an increasing outer surface circumference along the length of the handle to form a generally conical shape with a pole attached on the center, axial axis of the grip handle. The cone shaped grips have a first end which is the vertex above the center of the base and a second end at the base of the cone. The diameter of the first end is smaller than the diameter of the second end forming the conical shape. Typically, the diameter of the first end is from about ¾ inch to about 1¼ inches, preferably about 1 inch. The diameter of the second end is approximately 2½ inches but varies from the diameter of the first end in an amount that forms an angle from about 10 degrees to about 35 degrees, preferably from 15 degrees to 25 degrees, most preferably about 18 degrees. The smaller the angle, the less bulk material is required for a grip of standard length but the reaction force also decreases since it is a component of the angle such that below 10 degrees for a standard single hand length grip, the user does not receive the full benefit of the distribution of the load applied to the pole handle across the user's hand thus requiring more grip strength, higher handle coefficient of friction, and more hand squeezing force to hold onto the grip handle. On the other hand, when the angle is greater, more bulk material is required for a standard length grip and to form the grip larger than about 35 degrees the grip force is unequally transferred into the fingers closest to the front end, rather than distributing over the hand; additionally, the bulk of the grip is cumbersome. The cone angle is ideally sized around 18 degrees to fit the palm and fingers wrapped around the grip in a relaxed hand position for a range of hand sizes both adult and child.

When used on a pole, the length of the cone from front end to rear end may vary somewhat but is generally from about 4 inches to about 6½ inches, preferable 4½-5 inches for a one handed grip and twice that length for two hands on a single pole. This will ensure the handle works for those with smaller hands as they can grab near the front end and those with larger hands can have enough grip length to comfortably grip as well. The length of the grip is determined not only by standard handle lengths for each respective activity but by taking into account the average palm widths for most people. It is conceived a shorter handle size would be used for kids, possibly 3-inches to 4-inches in length. A child's pole grip would maintain a similar front end grip diameter to an adult grip but the cone angle would extend down such that the rear end has a small diameter due to the decrease in length, not a significant change in cone angle.

The pole grip conical handle should be durable for outdoor activity, be able to be cleaned of dirt, wick away sweat, and possibly add additional friction hold features. The conical grip may be made of a soft rubber or silicon-like material that may also be slightly tacky to the touch. Other materials may include a foam, cork, plastic, wood, or the like. Note that the material can deform slightly but must maintain the general cone shape of the outer grip surface. Many construction techniques could be used in the creation of the pole grip. It may be constructed of a few different materials and pieces to create an internal hollow structure with an external grip or may be a single piece construction. The grip may feature additional friction features like spirals, rings, and small notches to further increase the friction lock.

The key features of the present disclosure pole grip are that it allows for a force to be applied through the center axis of the grip handle with minimal hand squeezing force to maintain the hand's hold on the grip handle. The grip should be oriented for the pole's activity. The grip would have the front end of smaller cone diameter oriented at the top of the pole and the larger diameter, rear end towards the end of applied load toward the hand grip. This is the configuration of poles configured for skiing, hiking, walking, and other similar activities. In another configuration the handle may be installed with the larger, rear end on the top of the pole and the front end located axially toward the end of the pole. In this configuration, it could effectively resist something pulling the pole out of the users hands, like the centrifugal force from swinging a golf club or baseball bat working to pull the club or bat (pole) out of a user's hands during the swing. In the case of a golf club, or baseball bat, a longer grip capable of supporting two hands on the grip would be used, where a tennis racquet would only require a single grip. In the embodiment of a two-handed grip, it would also use the smaller cone angle so that the bulk of the grip on the rear end (top of the grip) is not too bulky and does not limit the user's functional movement during the activity. Cone angle would therefore be about half for the two handed grip, in the range of about 5 to 10 degrees. It is also conceived that another embodiment that the anti-fatigue grips could be attached to the pole with an orientation where both ends of the poles are used in the activity, as would be required for kayaking. In this embodiment, a two grips would be located on the paddle pole and oriented with each grip's front end toward the center of the paddle and the rear end of the grips toward each respective end of the pole containing the paddle. In this embodiment, the two grips would be mounted so the orientation of each grip is a mirror about the center of the long-axis length of the paddle, allowing the kayaker to plunge the paddle into the water with less fatigue.

The present disclosure provides a more ergonomic and comfortable handle that requires less grip strength thus making it a prime design for poles used in sports like skiing and hiking and general walking sticks, including canes.

Specific embodiments of the present disclosure provide for an anti-fatigue grip comprising a core portion, the core portion having a cylindrically shaped interior portion with side walls defining a channel extending from a first end to a second end of the core portion, and an exterior portion disposed upon the interior portion and increasing in diameter from the first end to the second end of the core portion at an angle in the range of about 10 degrees to about 25 degrees, the exterior portion defining a conical shape, and an interior structure defined by a surface of the interior portion and a surface of the exterior portion; and, a grip portion disposed upon the exterior surface of the core portion.

Further specific embodiments of the present disclosure include an apparatus comprising a grip member, the grip member having a cylindrically shaped interior portion with side walls defining a channel extending from a first end to a second end of the grip member, and an exterior portion increasing in diameter from the first end to the second end at an angle in the range of about 10 degrees to about 25 degrees, the exterior portion defining a conical shape.

Still further specific embodiments of the present disclosure include an a anti-fatigue grip assembly comprising a grip member, the grip member having a cylindrically shaped interior portion with side walls defining a channel extending from a first end to a second end of the grip member, and an exterior portion increasing in diameter from the first end to the second end at an angle in the range of about 10 degrees to about 25 degrees, the exterior portion defining a conical shape; a grip stop coupled to the grip member at the first end; and, a pole coupled to the interior portion of the grip member.

Other objects, features and advantages of the present disclosure will become apparent from the following detailed description taken in conjunction with the accompanying drawings.

BRIEF DESCRIPTION OF THE DRAWINGS

Having described the disclosure in general terms, reference will now be made to the accompanying drawings, which are not necessarily drawn to scale, and wherein.

DETAILED DESCRIPTION

The present disclosure now will be described more fully hereinafter with reference to the accompanying drawings, in which preferred embodiments of the disclosure are shown. This disclosure may however, be embodied in many different forms and should not be construed as limited to the embodiments set forth herein; rather these embodiments are provided so that this disclosure will be thorough and complete, and will fully convey the scope of the disclosure to those skilled in the art.

Figure 2:
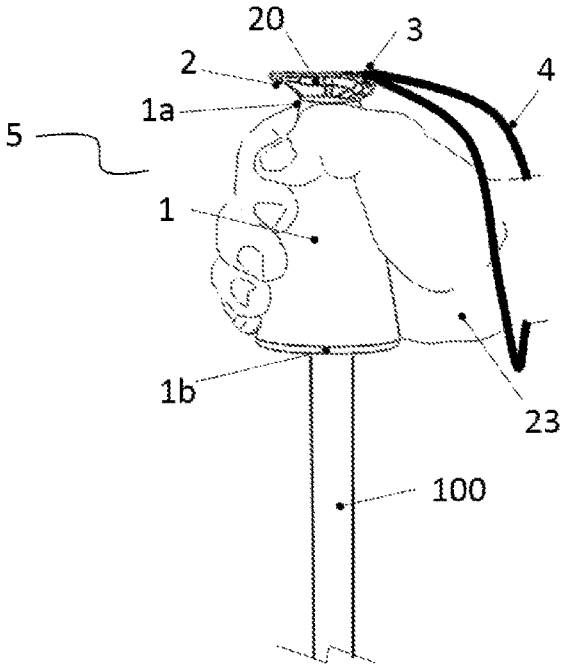
FIG. 2 illustrates an isometric view of an embodiment of the present disclosure showing a user's hand on the cone shaped grip attached to a ski pole.

The object of the present disclosure is the elements of the grip design itself attached to a pole for sporting activities. Turning now to FIG. 2 there is shown an embodiment of the present disclosure for a grip 1 attached to a ski pole 100. A uniquely shaped grip handle 1 having many uses, especially attached to various types of poles 100—hiking sticks, ski poles, snow shoeing poles, canes, etc. The grip 1 of handle assembly 5 has an increasing outer surface circumference along the length of the handle to form a generally conical shape with a pole 100 attached on the center, axial axis of the grip handle assembly 5. The cone shaped grips 1 have a front end 1*a* which is the vertex above the center of the base and a rear end 1*b* at the base of the cone. The diameter of the front end 1*a* is smaller than the diameter of the rear end 1*b* forming the conical shape. Typically, the diameter of the front end is from about ¾ inch to about 1¼ inches, preferably about 1 inch. The diameter of the rear end 1*b* is typically 2½ inches but varies from the diameter of the front end in an amount that forms an angle from 10 degrees to 35 degrees, preferably from 15 degrees to 25 degrees, most preferably about 18 degrees. The smaller the angle and length of the grip, the less bulk material is required for a grip 1 of standard length but the total axial reaction force decreases for the same hand squeezing force 45 (FIG. 4) such that below 10 degrees the user does not receive the full benefit of the hand locking force 40 (FIG. 4) thus requiring more grip strength and hand squeezing force 45 to hold onto the grip handle 1. On the other hand, when the cone angle is greater, more bulk material is required for a standard length grip 1. A grip 1 having a cone angle larger than about 35 degrees yields an uncomfortable gripping angle for the hand and it is harder to hold when lifting in the axial direction opposite the primary load (i.e. when lifting the hiking pole up to take another step) because it is harder to grasp in the hand. It can also cause unequal transfer of axial load into the fingers closest to the front end 1*a*, rather than distributing over the entire hand like the preferable cone able grip 1. Additionally, if the cone angle is too large, the bulk of the grip are cumbersome and undesirable. The cone angle is ideally sized around 18 degrees to fit the palm 20, fingers 21, and thumb 22 wrapped around the grip 1 in a relaxed hand position for a range of hand sizes both adult and child. Note that the hand is oriented on the grip 1 with the thumb 22 and index finger 21 at the front end 1*a*.

The grips 1 as shown in the embodiment in FIG. 2 on a ski pole 100 have a length of the cone handle from front end 1*a* to rear end 1*b*. The length may vary somewhat but is generally from about 4 inches to about 6½ inches, preferable 4½-5 inches for a one handed grip 1. In other embodiments discussed later where two hands are placed on the grip 1 attached to pole 100, the length will be about twice that length and to reduce the ultimate bulk, while not achieving maximum axial load, the handle will have a smaller cone angle to ensure the rear end 1*b* of the grip 1 over that length does not yield a diameter much larger than 2½ inches.

In the most preferable embodiment, the single hand grip 1 has a 4¾ inch length, 18-degree cone angle, with a 1-inch front end diameter and 2½ inch rear end diameter. This will ensure the handle 1 works for those with smaller hands as they can grab near the front end 1*a* and those with larger hands can have enough grip length to comfortably grip as well. The length of the grip 1 is determined not only by standard handle lengths for each respective activity but by taking into account the average palm widths for most people. It is conceived a shorter handle size would be used for kids, possibly 3-inches to 4-inches length. Note that a child's pole grip 1 would maintain a similar front end 1*a* grip diameter to an adult grip but the cone angle would extend down such that the rear end has a small diameter due to the decrease in length, not a real change in cone angle.

Figure 1:
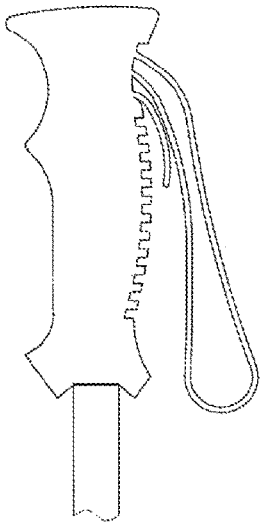
PRIOR ART FIG. 1
FIG. 1 illustrates a hiking pole handle representative of the prior art.

The shortcomings of the prior art are addressed by the innovation of the present disclosure pictured in FIG. 2 featuring a cone shaped grip 1 that maximizes the friction force with the shape of the grip within the design constraints of proper handle design (bulk of material, length to fit common hand sizes, etc.) to allow the hand to be in a relaxed grip position, exerting minimal hand squeezing force, and yet being able to withstand the force applied axially through the pole during the activity. In this embodiment as a ski pole shown in FIG. 1, the axial load comes from the ground holding the user's weight and momentum, such that the hand does not lose grip with the pole handle 1 as the user skis on snow. The present disclosure provides all the standard features of a pole handle assembly 5 to include safety straps 4 that couple in various manners to the handle core 20 by attachment means 3. Attachments means 3 may be a pin or integrally formed feature in the core 20 that allows the strap to be secured but adjusted in length to accommodate the user. The strap 4 may even include a feature that wedges into place on the core 20 feature to attach 3 it and allow adjustability. The handle core 20 includes a top grip stop 2, and various integration techniques to attach the pole core to the pole or stick 100. The grip 1 is attached to the handle core 20 through gluing, over-molding, mechanical fastening or a combination of different fastening techniques.

The pole grip assembly 5, including the grip 1 will need to be durable for outdoor activity and be able to be cleaned of dirt. The grip 1 will need to be able to wick away sweat, and possibly add additional friction features 10 (FIG. 3) to increase the coefficient of friction and further minimize the hand squeezing force 45 (FIG. 4) required to keep the hand from sliding down during use. The conical grip 1 may be made of a durable rubber or silicon like material that may also be slightly tacky to the touch. Other materials may include a dense foam, cork, plastic, carbon fiber, wood, or similar. Likely the core 20 would be made of plastic of a harder material such as plastic, carbon fiber, or thermoplastic elastomer that are generally rigid in nature. Many construction techniques could be used in the creation of the pole grip assembly 5. It may be constructed of a few different materials and pieces to create an internal hollow structure with an external grip 1 (FIG. 8) or may be a single piece core 20 construction with bulk grip (FIG. 7, FIG. 9) or the entire handle assembly 5 could be a single piece construction. The grip 1 may feature additional friction features 10 (FIG. 3) like spirals, rings, and small notches to further increase the friction lock from the increase in the coefficient of friction. The pole 100 may be made of carbon fiber tube, aluminum tubing, solid wood, a composite material, or other rigid material with proper strength for the activity and forces applied. The pole and handle assembly may be a single piece construction too in other embodiments of the present invention. For example, in a walking stick made of a single piece of wood.

Figure 3:
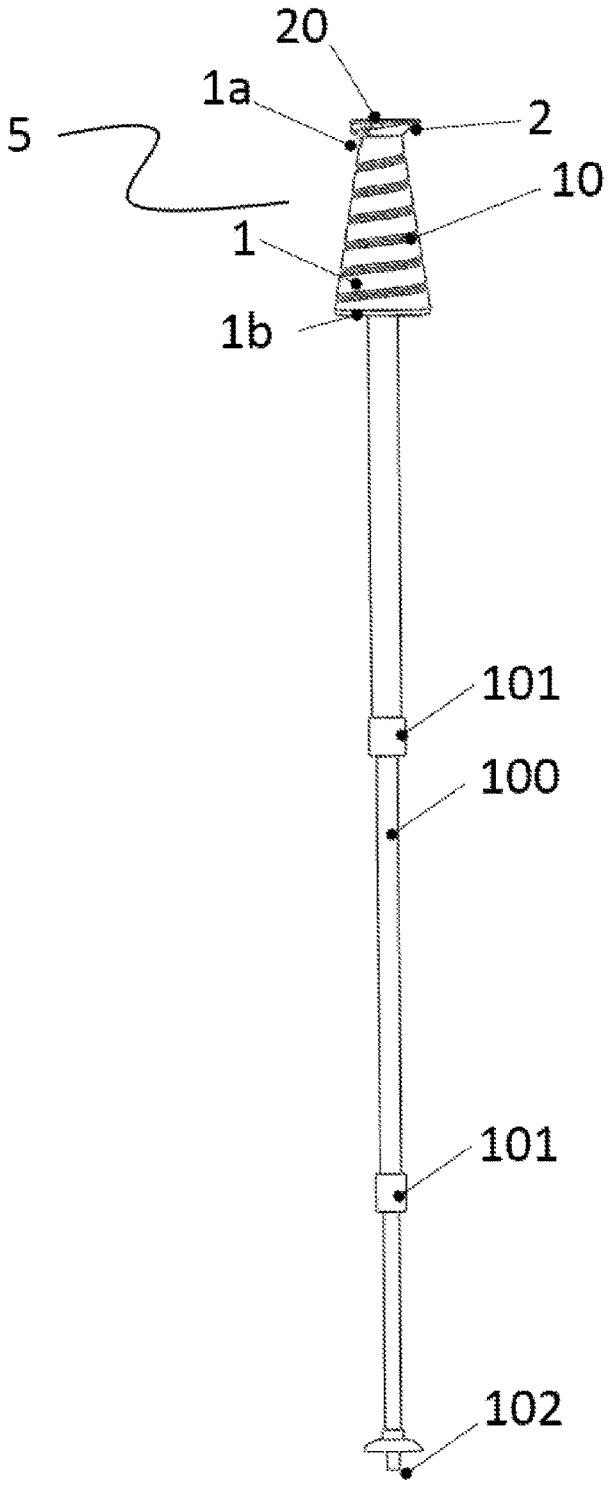
FIG. 3 is an left-side view of an embodiment of the present disclosure showing a collapsible hiking pole with a cone shaped grip.

FIG. 3 shows another embodiment of the cone grip on an adjustable hiking pole. The pole 100 in this embodiment includes clamps 101 at various points along the length to allow for adjustment. The grip handle assembly 5 includes the hard plastic handle core 20 with grip top stop 2 to prevent the hand from sliding off the pole when the user is lifting the pole, cone grip 1 made of rubber, and a friction features 10 in the shape of spiral indention to increase the coefficient of friction and allow for sweat to wick away from the hand. The base of the hiking pole 102 impacts the ground during hiking and transfers the user's weight and momentum axially through the pole 100 center axis and through the grip 1 to react against the hand. Typically, during hiking one or two hiking poles or walking sticks are used to add stability, balance, and reduce overall user fatigue.

Figure 4:
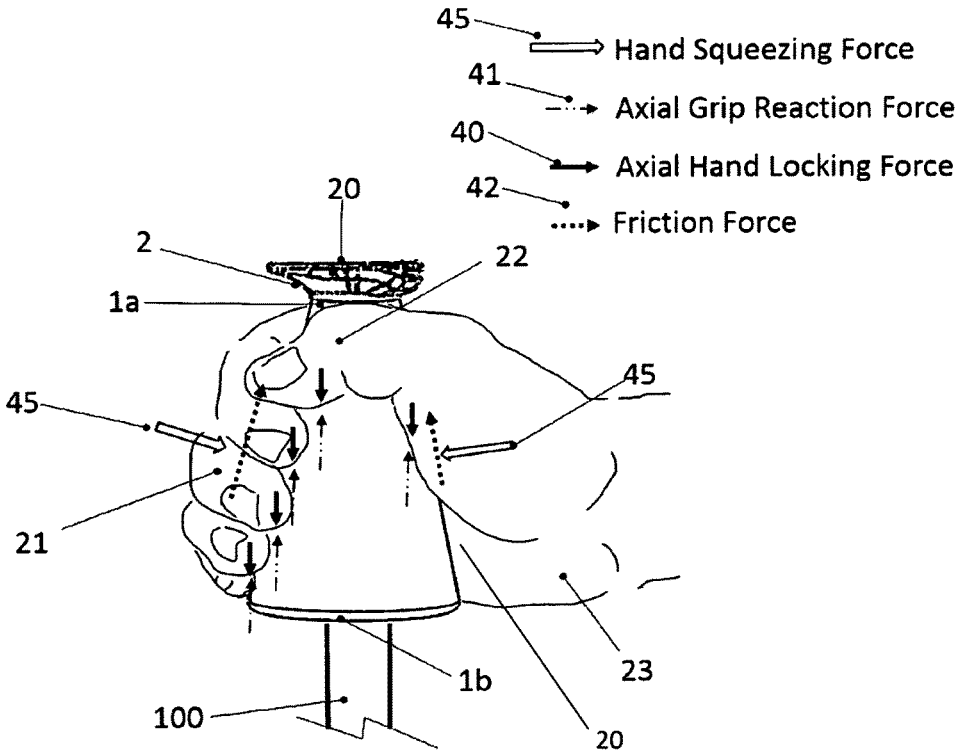
FIG. 4 is a depiction of a user's hand on the cone shaped grip of the present disclosure detailing the friction force and hand-squeezing force.

Most prior art grips rely on the friction force versus directly reacting the loads caused from the activity. Friction force 42 equals the coefficient of friction of the two mating surfaces (hand 23 and grip 1 in this case) and the normal force applied between the objects (hand squeezing force 45). Note this force of friction equation assumes that both the grip and the hand are solid bodies which is a good enough approximation for determining the primary loads in this example. As depicted in FIG. 4 with a force diagram of the present disclosure, the shape of the grip 1 allows for maximum axial load reaction force 41 to lock the hand 23 thus reducing the hand squeezing force 45 required to lock the hand into place. This object of the present disclosure is a multi-purpose pole grip 1 to resist the hand from sliding down the handle 1 under the peak use load case when the hiking pole is under axial loading. As shown in FIG. 4, the shape of the cone 1 maximizes the axial load that can be carried by the pole handle assembly 5 with minimal required hand squeezing force 45. Using the unique shape within reasonable dimensions for a handle 5, the cone grip 1 allows the axial hand force 40 from the user's applied load to be reacted by the grip 1 axial reaction force 41 and the load is reacted over a significant area of the hand 23 while the hand 23 is in a mostly relaxed state. To further reduce the hand fatigue, the friction force 42 can be increased thus reducing any squeezing force 45 required by the hand 23, the grip 1 may include friction features 10 (FIG. 3), and materials with higher coefficient of friction surface finishes. Thus the present disclosure can provide all the friction force 42 features 10 of the prior art and when coupled with the axial load carrying element of the cone shaped grip 1, it yields a more ergonomic and comfortable handle 1 that requires less grip strength 45, making it an optimal design.

The axial hand locking force 40 and reaction force 41 locking the hand into place can be thought about like two cones stacked on top of each other. The top cone of similar size will not slip past the bottom cone because the shape, not the friction force 42 holds them locked together under axial load. The hand's 23 natural relaxed state makes a general conical shape. The hand 23 will require a little griping force 45 to keep the hand 23 on the cone handle 1 but nothing compared to the prior art.

Figure 5:
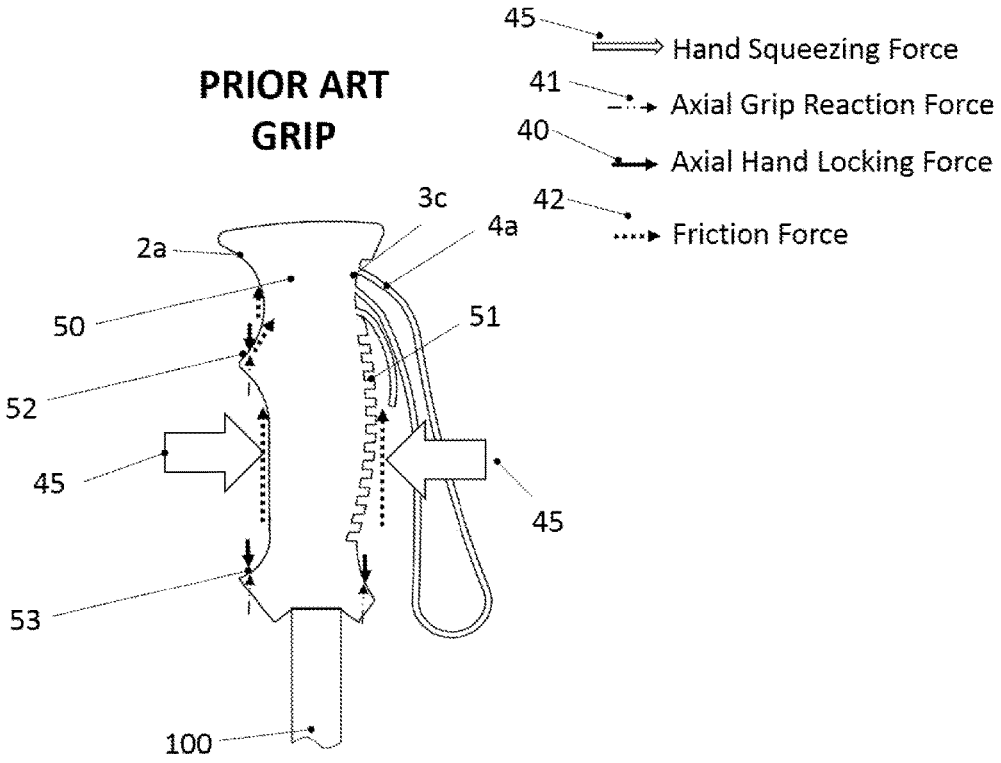
FIG. 5 is a depiction of the prior art grip detailing the friction force and hand-squeezing force resulting from a user's hand on the grip.

By comparison, the prior art handle design 50 shown in FIG. 5 requires a hand squeezing force 45 to create most of the friction force 42 to lock the hand 23 into place for the same coefficient of friction grip material as the present disclosure. This is because the prior art handle design 50 has a non-ideal shape to directly react the axial load. The prior art handle design 50 has little axial load carrying surface areas 51, 52, and 53 to react the hand axial force 40 caused by the user's weight when the hiking or ski pole strikes the ground; thus it must rely on friction forces 42 created from squeezing 45 the grip 50 to lock the hand into place. The cone grip 1 of the present disclosure detailed in FIG. 4 shows that the axial load can be carried over the surface of the hand 23 versus just the little load carrying surfaces 51, 52, and 53 in the prior art handle design 50 in FIG. 5. When the present grip disclosure as detailed in FIG. 4 is coupled with a grip material and surface of similar coefficient of friction to the prior art handle design 50 in FIG. 5, the squeezing force 45 is significantly reduced. This reduces hand and forearm fatigue, makes for a more comfortable grip, and makes the object of the present disclosure a significant improvement over the current state of the art. The prior art designs include similar pole handle items such as a top grip stop 2*a*, strap 4*a* attached to the handle 50 at point 3*c*. The pole handle also similarly attaches to the pole 100 on the pole handle 50 center axis.

Figure 6:
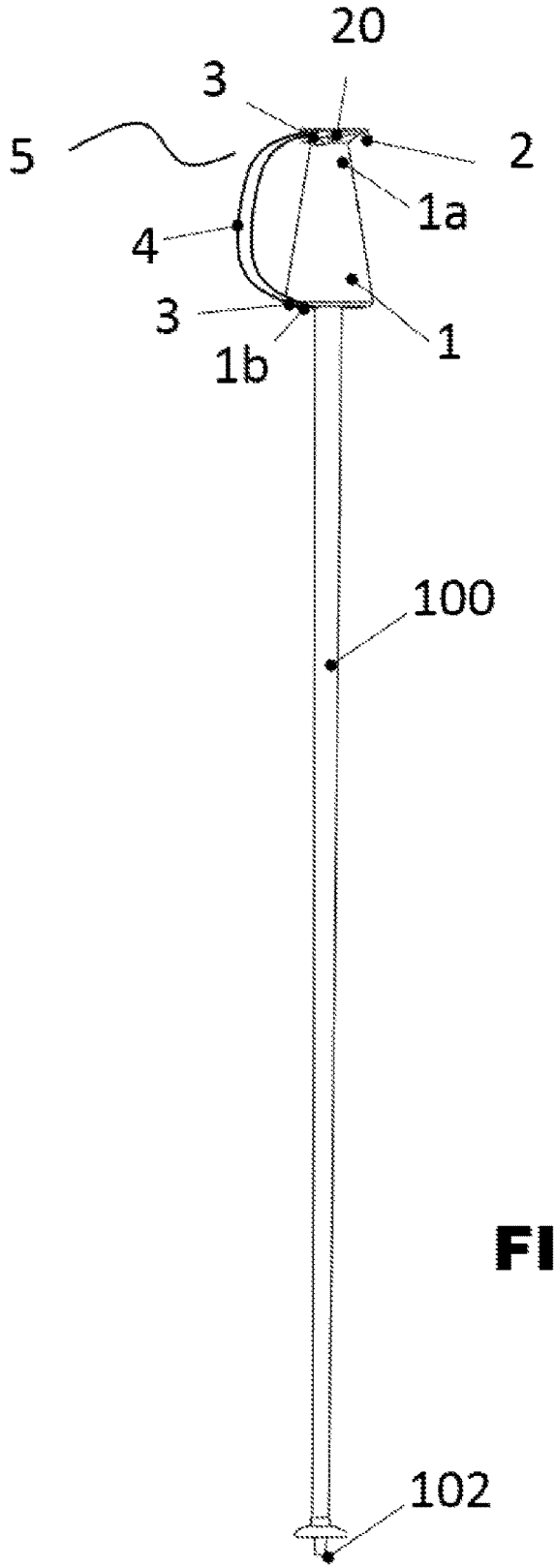
FIG. 6 is a second embodiment of the grip on a ski pole.

Another embodiment of the present design is shown in FIG. 6 with the cone grip 1 on a ski pole. The pole 100 includes a single tube construction of carbon fiber or aluminum. The base 102 of the pole 100 includes attachments to allow for it to stabilize the skier on the snowy ground and distribute the load so the pole doesn't sink. The grip handle assembly 5 of this embodiment includes another design of a strap 4 where the strap 4 is made of a more rigid material and extends from the front end 1*a* of the grip 1 to the rear end 1*b* to allow for securing the hand to the grip. The strap 4 is held to the core 20 by different fastening means 3. In one embodiment of the strap 4 this is a webbing loop, in another a solid piece with the core 20, and various other methods to attach the strap 4. The ski pole in the present embodiment includes the grip 1 with a high coefficient of friction surface material like cork and does not include any additional friction features 10 like the grip 1 shown in FIG. 3. While friction features 10 increase the coefficient of friction, they are not required of the present design to achieve the bulk of the grip-lock. The cone angle with a sufficient material selection for the grip 1 is the primary driver and adding friction features 10 is just a bonus.

Figure 7:
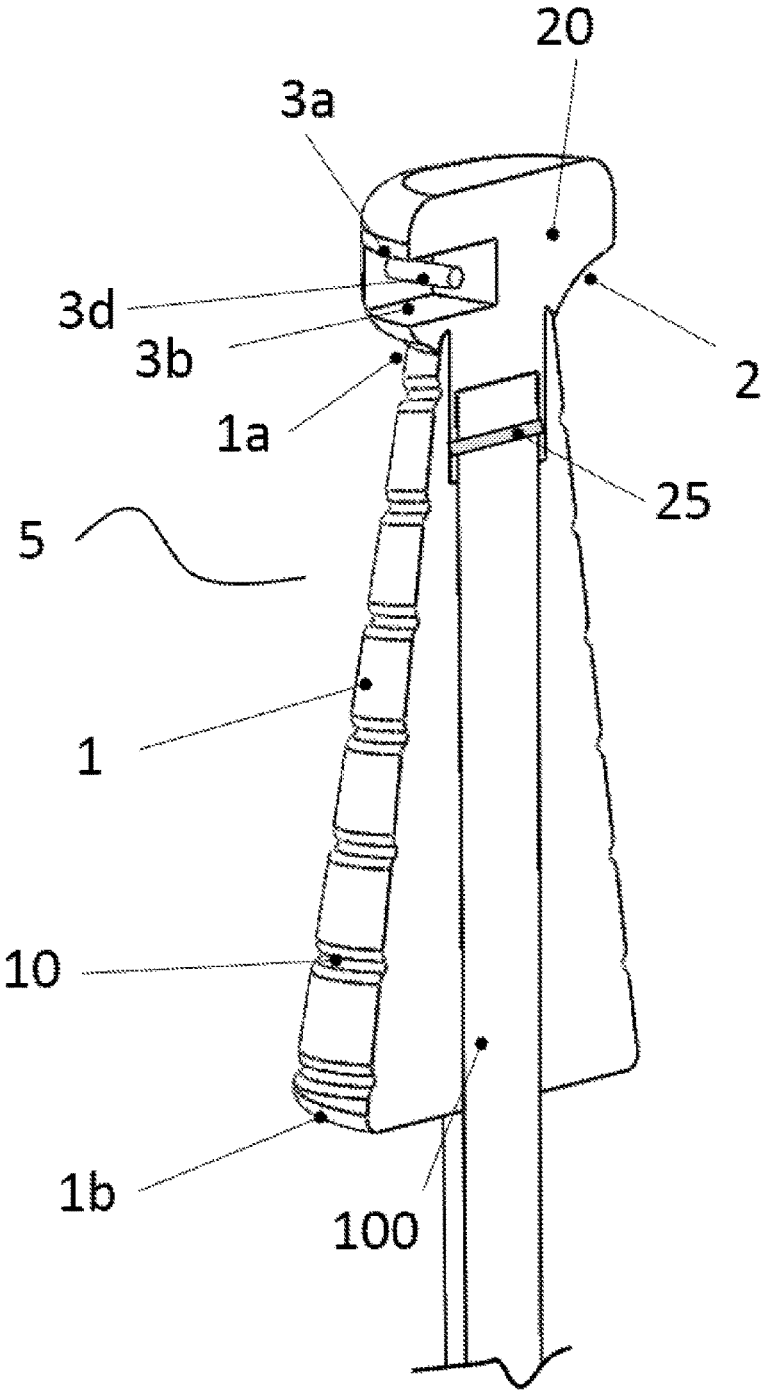
FIG. 7 is a left-side, isometric view cross-section of an embodiment for a hiking pole grip.

FIG. 7 shows a left-side, cross-section in an isometric view of one embodiment of the pole handle assembly 5 on a pole 100. This embodiment of the handle assembly 5 has a core that doesn't extend all the way to the rear end 1*b* and the cylindrical cavity where the handle assembly 5 mates to the pole 100 uses a bulk material like dense foam for the grip. The core 20 includes a structure with a short cylindrical cavity to slide over the top of the pole 100 and attach the core to the pole 100 via a pin 25. This core 20 structure also may be under the grip 1 running some length from the front end 1*a* towards the rear end 1*b*. In this case it is of only enough length to secure it to the pole 100. In FIG. 7 embodiment of the present invention, it also shows another configuration for the strap 4 retention using a pin 3*d*. The strap 4 in this design uses a wedge plastic piece usually rivet attached to the strap 4 that secures itself inside the core 20 strap cavity opening 3*a* to cavity opening 3*b* to wedge tight against the strap 4 as it is wrapped over the pin 3*d* from core strap top area 3*a* to core strap base cavity 3*b*. This allows the user to adjust the strap 4 length by removing the wedge lock, adjusting the strap 4 loop and rewedging the wedge on the end of the strap into the strap 4 cavity. The grip 1 is made of a material like eva foam. In this embodiment, the material should be light since a large volume is being used. A cork or light rubber could also be conceived. The grip 1 is glued to the pole 100 and the portion of the core 20 extending beneath it to secure it. A friction feature 10 adds additional surface friction to hold the users hand in place. In another embodiment of the design shown in FIG. 7 the core 20 and the grip 1 are made of a single piece. Only the strap 4 and strap attachment pin 3*d* would be separate components. In this embodiment it yields faster manufacturing due to the lower part count and manufacturing would be done by overmolding the grip 1 and core 20 as a single piece structure onto the pole 100 or gluing the handle assembly in place on the pole 100 top end. In this embodiment a pin 25 would not be used.

Figure 8:
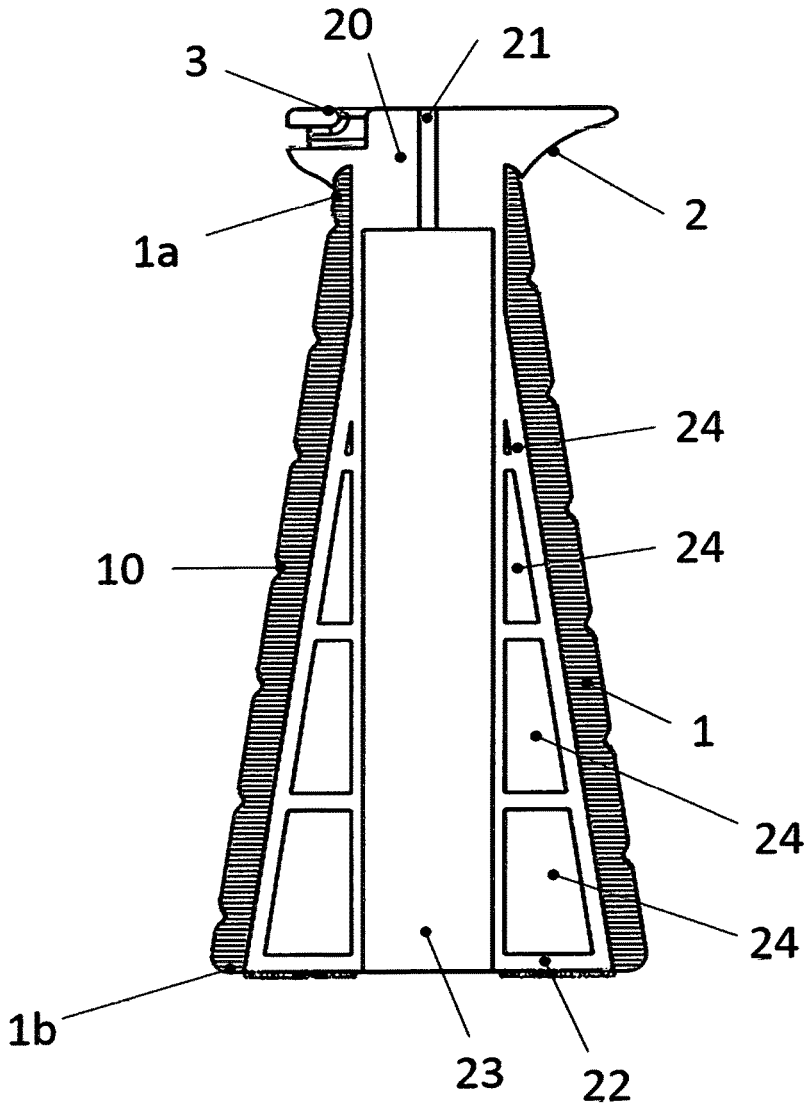
FIG. 8 is a left-side, cross section of an embodiment for a hiking pole grip showing a hollow internal structure with overmolded grip design.

FIG. 8 shows a left-side cross-section of another embodiment of the pole handle assembly 5. This embodiment of the handle assembly 5 includes a hollow core structure 20. This core 20 is likely injection molded plastic or thermal plastic elastomer that is rigid enough to not deform under normal loads typical of hiking and skiing. This embodiment shows an overmolded grip 1 made of rubber-like material with a durometer of less than Shore 55 A. It could also be made of silicon, an EVA foam, cork, or other like material or combination of materials. The grip 1 should have a nice feel on the hand but still have a good coefficient of friction, be generally sticky in nature, be able to withstand the outdoor elements without degradation, and wick away sweat. The grip 1 may also be constructed separate of the internal core 20 and then friction slipped, fastened, or glued to the core structure 20. The core 20 should be solid but light. To keep material costs down and maintain a lightweight handle assembly 5, it should have hollow cavities 24. The pole 100 would then be inserted into the cylindrical cavity 23 and glued or pinned inserted perpendicular to the long axis of the pole towards the front-end 1*a* (top portion) of the core 20. There are many other ways to secure the pole to the handle assembly 5 that would be obvious to someone skilled in the art. During the process of assembling the pole 100 into the core 20 cavity 23, air can be released via vent 21. This may not be necessary if the pole 100 is not sealed. The base of the core 20 near the rear-end 1*b* needs to be capped with a core 20 end 22 such that dirt does not get trapped inside the core structure 20. In another embodiment of the present configuration, the core 20 may be open and not capped with an end 22. In this embodiment the core would have a internal cone structure secured to the pole 100 toward the front end 1*a*. In the embodiment shown in FIG. 8, a spiral indention friction feature 10 is added to further increase the friction force.

Figure 9:
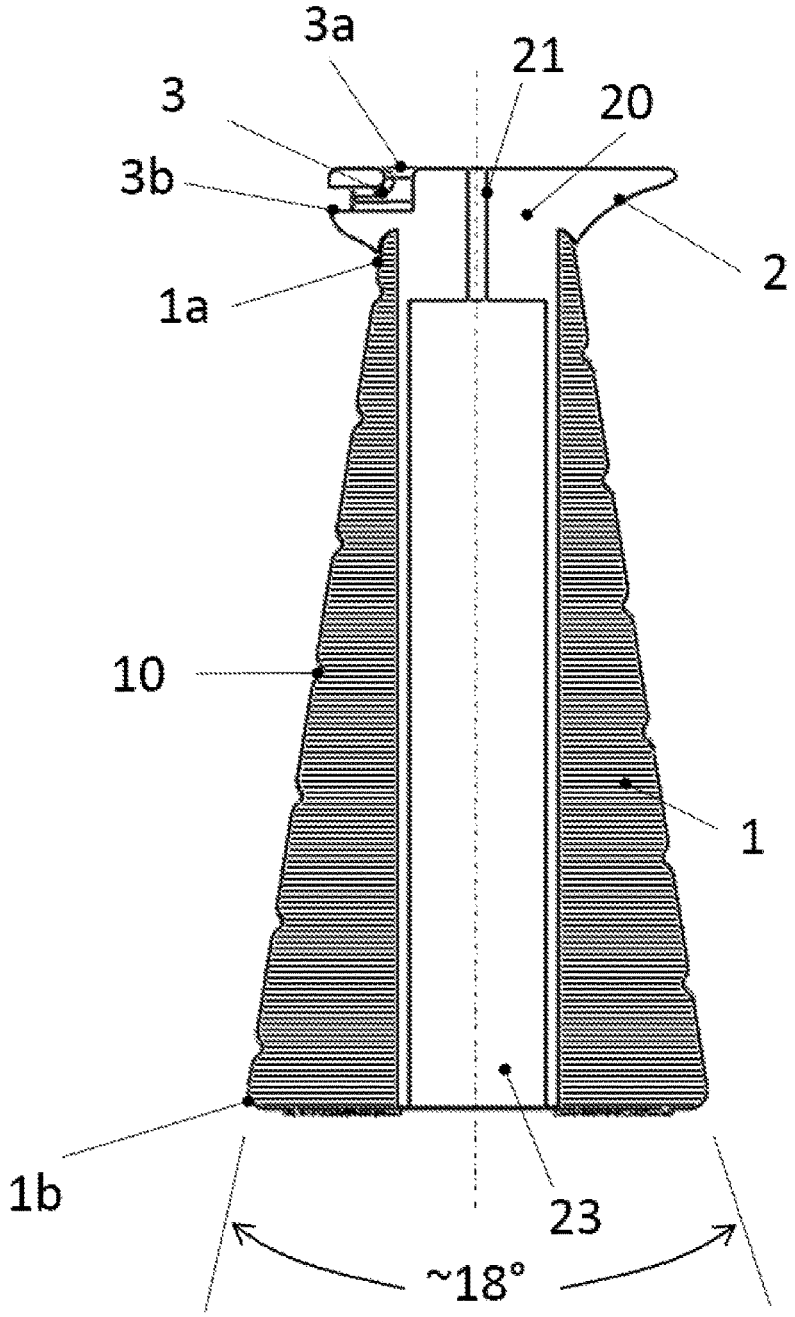
FIG. 9 is a left-side cross section of an embodiment for a ski pole grip of the present disclosure showing another grip construction method.

FIG. 9 shows a left-side cross-section of another embodiment of the pole handle assembly 5 featuring a slimmer core 20 likely made of injection molded part. In one embodiment this is a single piece core and in others, it may be constructed of multiple pieces. It must be rigid to handle the loads of the activity. Furthermore, this embodiment includes a bulk grip 1 design having an approximate 18-degrees cone angle. Instead of using the core structure 20 to form the volume of the cone shape, as seen in FIG. 8, this embodiment shows how the grip 1 can form the cone shape. It is desirable in this embodiment that the grip 1 be made of a lightweight but generally rigid material such as cork, foam that cannot deform too much under load of the hand, or similar. While the grip 1 could be a rubber-like material, likely a rubber molded material would not be as lightweight as the other material options. A spiral indention friction feature 10 is present in this embodiment as well. The core 20 includes a cylinder cavity 23 to mate with the top portion of the pole 100. An air vent 21 is present to relieve any air pressure and would be capped or filled so external contaminates (water, debris, etc.) could not get in. A webbing strap 4 (not pictured in this figure) is attached to the core 20 by threading it through cavity opening 3*a* and feeding it back out cavity opening 3*b*. Using a plastic slide stop buckle, the webbing strap 4 can be made of polypropylene, nylon, or similar material and can be formed into a loop and adjusted for the user length preference to secure it around the user's wrist. Many methods of attaching the strap to the pole can be conceived and is not the novel element of this disclosure. The core 20 also includes a top grip stop to allow the user to lift the grip easily upward along the long axis of the pole 100. The grip stop 2 ensure the hand does not slide off the handle assembly 5. Using a grip stop in this direction is okay because the user is only lifting the weight of the hiking pole.

Figure 10:
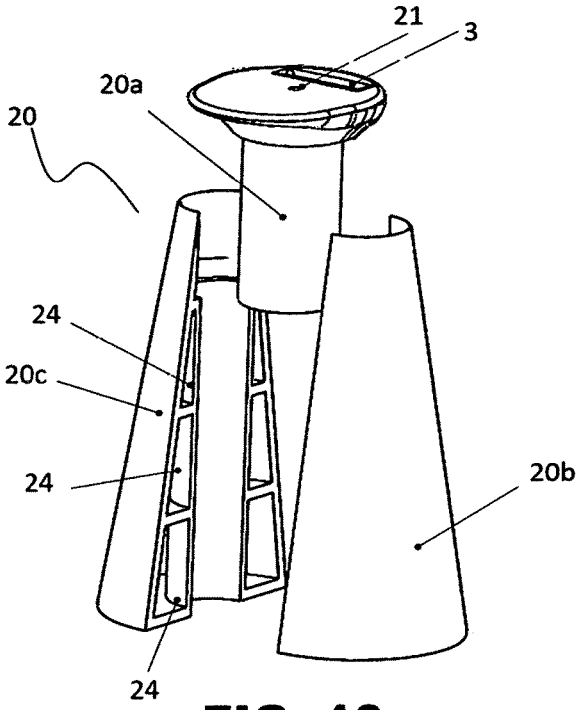
FIG. 10 is an exploded view of one embodiment for the hollow internal structure shown in FIG. 8.

FIG. 10 is an exploded view of one embodiment for the hollow internal core structure 20 shown in FIG. 8. It includes a clamshell cone internal structure with halves 20*b* and 20*c*. These are likely injection molded plastic pieces and include hollow cavities 24. The two clamshells halves 20*b* and 20*c* mate together to form the cylindrical cavity 23 for the pole. The halves 20*b* and 20*c* are mated and fastened to the top core 20*a*.

Figure 11:
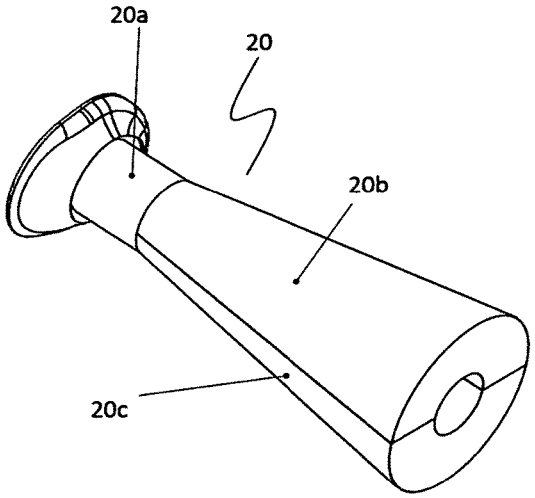
FIG. 11 is an isometric view of the internal structure of FIG. 10 in the assembled state.

FIG. 11 is an isometric view of the internal hollow structure of FIG. 10 in the assembled state with the clam shell core structure halve 20*c* mated to 20*b* around the tubular structure of 20*a* to form a one-piece rigid structure for the core 20. The cross-section view of this core with the overmolded grip 1 included is shown in FIG. 8.

Figure 12:
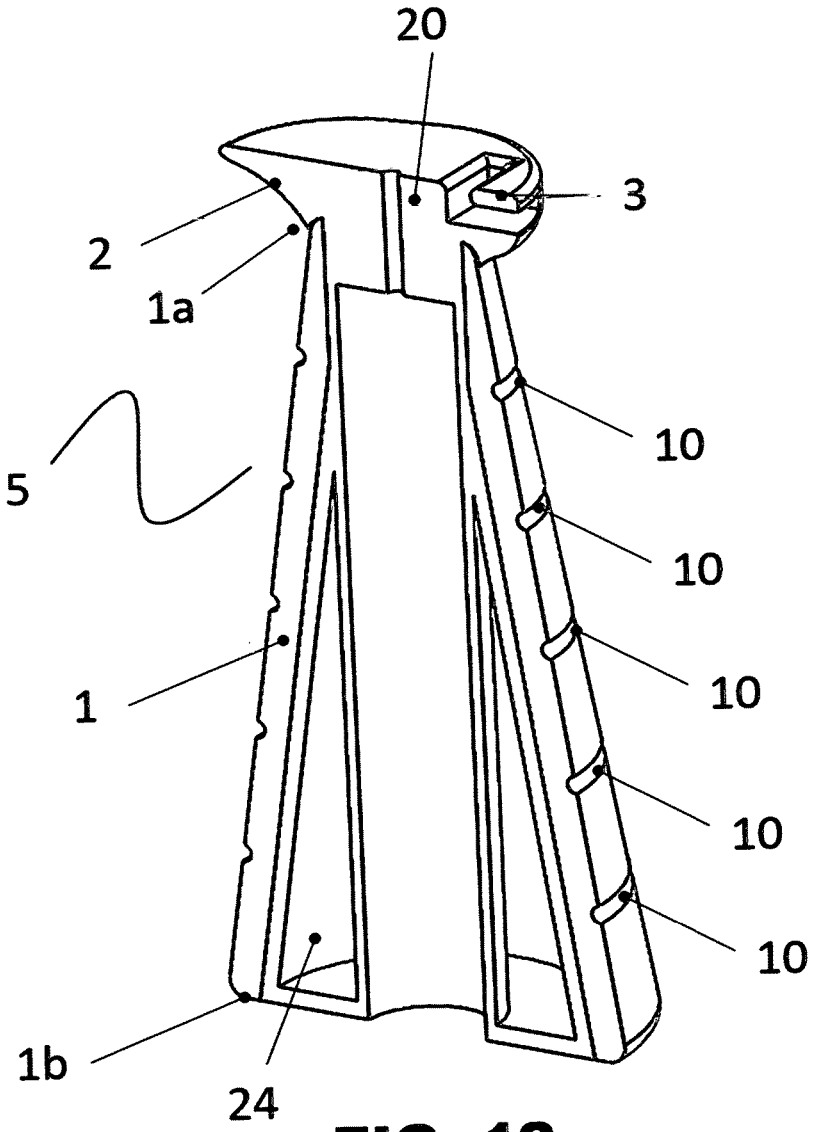
FIG. 12 is an isometric view, cross-section of an alternate internal structure of FIG. 10.

FIG. 12 is another embodiment of the hollow core structure 20 for the grip handle assembly 5 of the present disclosure with a spiral indention. It includes a single hollow cavity 24 design.

Figure 13:
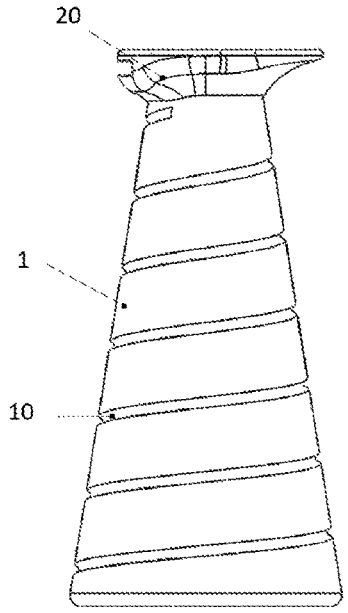
FIG. 13 is a front view of another embodiment of the grip handle of the present disclosure with a spiral indention.

FIG. 13 is a left side view of another embodiment of the grip handle assembly 5 of the present disclosure with a spiral indention 10. This grip could have a hollow core 20 like FIG. 12 or FIG. 8. In another embodiment it could have a bulk grip design like FIG. 9. From the outside view of the handle assembly 5, the internal construction methods would not be apparent. The construction method would be chosen based on material cost, manufacturing costs, ease of assembly, and overall weight of the handle assembly, and materials selection to name a few design and manufacturing tradeoffs.

Figure 14:
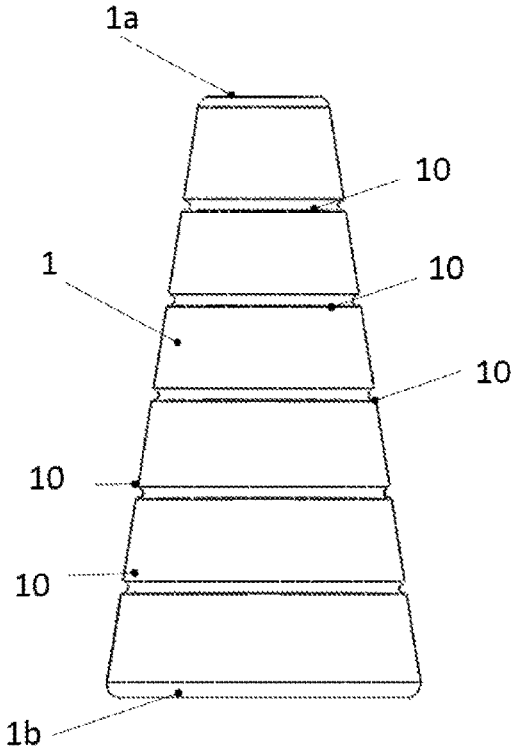
FIG. 14 is front view of another embodiment of a single piece grip handle of the present disclosure showing a series of circle indentions.

FIG. 14 is front view of another embodiment of a single piece grip 1 embodiment of the present disclosure showing a series of circle friction features 10 evenly spaced from the rear end 1*b* to the front end 1*a* of the grip 1. In this embodiment the handle assembly 5 is the grip 1 itself. The core and the grip 1 are a single piece and in this embodiment no top grip stop 2 exists and relies on just the user's grip strength and the resulting friction force to allow the user to lift the pole 100 with this grip assembly 5.

Figure 15:
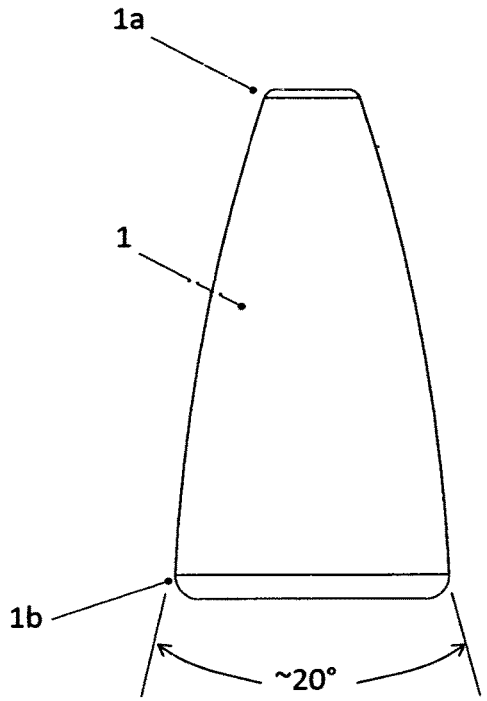
FIG. 15 is a front view of another embodiment of the grip having a slightly different conical configuration.

FIG. 15 is a front view of another embodiment of the grip 1 having a slightly different conical configuration with a general cone angle of 20-degrees. The surface of this grip has a bulbous look.

Figure 16:
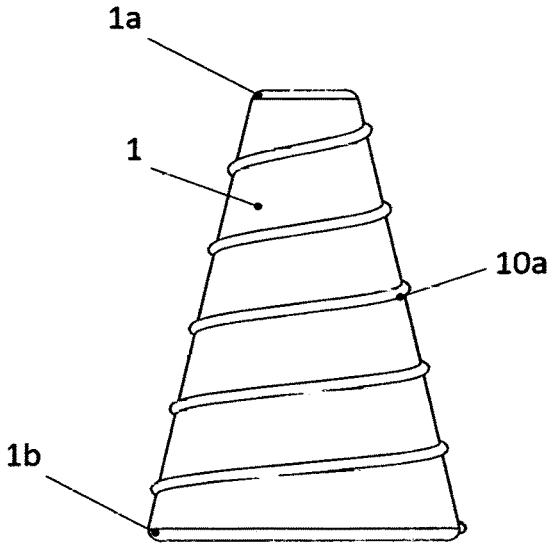
FIG. 16 is front view of another embodiment of the general grip of the present disclosure showing protruding spiral design.

FIG. 16 is front view of another embodiment of the general grip of the present disclosure showing protruding spiral design 10*a* running form the rear end 1*b* to the front end 1*a*.

Many types of poles could be used for the present disclosure pole handle. The pole could be collapsible and the pole handle assembly 5 may include provisions for a release and or locking button on the core 20. The pole end could have many different types of end attachments designed for different activities and different amounts of stability. The could be modular or integrated into the pole 100.

The grip should be oriented for the pole's activity. The grip would have the front end of smaller cone diameter oriented at the top of the pole and the larger diameter, rear end (second end) towards the end of applied load toward the hand grip. This is the configuration of poles configured for skiing, hiking, walking, and other similar activities.

In another configuration the handle may be installed with the larger, rear end (second end) on the top of the pole and the front end located axially toward the end of the pole. In this configuration, it could effectively resist something pulling the pole out of the users hands, like the centrifugal force from swinging a golf club or baseball bat working to pull the club or bat (pole) out of a user's hands during the swing. In the case of a golf club, or baseball bat, a longer grip capable of supporting two hands on the grip would be used, where a tennis racquet would only require a single grip. In the embodiment of a two handed grip, it would also use the smaller cone angle so that the bulk of the grip on the rear end (top of the grip) is not too bulky and doesn't limit the user's functional movement during the activity. Cone angle would therefore be about half for the two handed grip, on the order of 5-10 degrees. It is also conceived that another two-handle embodiment that the anti-fatigue grips could be attached to the pole with an orientation where both ends of the poles are used in the activity, as would be required for kayaking. In this embodiment, two grips would be located on the paddle pole and oriented with each grip's front end toward the center of the paddle and the rear end of the grips toward each respective end of the pole containing the paddle. In this embodiment, the two grips would be mounted so the orientation of each grip is a mirror about the center of the long-axis length of the paddle, allowing the kayaker to plunge the paddle into the water with less fatigue. Grip stops may or may not be part of this two handle pole embodiment.

Many modifications and other embodiments of the disclosures set forth herein will come to mind to one skilled in the art to which these disclosures pertain having the benefit of the teachings present in the foregoing descriptions. Therefore, it is to be understood that the disclosures are not to be limited to the specific embodiments disclosed and that modifications and other embodiments are intended to be included within the scope of the appended claims. Although specific terms are employed herein, they are used in a generic descriptive sense only and not for purposes of limitation.

What is claimed is:

1. An anti-fatigue grip comprising:

a core portion being configured to receive a terminal end of a pole, the core portion having a cylindrically shaped interior portion with sidewalls defining a channel extending from an upper end to a lower end of the core portion, and a lateral portion increasing in diameter from the upper end to the lower end of the core portion at an angle in the range of about 10 degrees to about 25 degrees, the lateral portion defining a conical shape, the core portion further comprising an interior structure having at least one non-deformable rib extending horizontally from the interior portion to the lateral portion to define a cavity, the lateral portion further comprising a grip stop portion extending from the upper end of the core portion; and, a grip portion disposed on a surface of the lateral portion of the core portion, a circumference of the grip portion adjacent to the lower end of the core portion defining a terminal surface of the anti-fatigue grip.

2. The anti-fatigue grip of claim 1 wherein the grip portion is constructed from a rubber material having a durometer of less than Shore 75 A.

3. The anti-fatigue grip of claim 1 wherein the grip portion further comprises a channel defining an indentation disposed upon a circumference of the grip portion and extending substantially the length of the grip portion in a spiral configuration.

4. The anti-fatigue grip of claim 1 further comprising a pole coupled to the interior portion of the core portion.

5. The anti-fatigue grip of claim 1 wherein the grip portion is constructed from a cork material.

6. The anti-fatigue grip of claim 1 further comprising a raised portion disposed upon a circumference of the grip portion and extending substantially the length of the grip portion in a spiral configuration.

7. The anti-fatigue grip of claim 1 further comprising a strap coupled to the grip stop portion.

8. The anti-fatigue grip of claim 1 wherein the grip stop portion further comprises a vent extending from a top surface of the grip stop portion to the interior portion of the core portion.

9. An anti-fatigue grip comprising:

a core portion being configured to receive a terminal end of a pole, the core portion being made of a non-deformable material and having a cylindrically shaped interior portion and a grip stop portion, the cylindrically shaped interior portion having sidewalls defining a channel extending from an upper end to a lower end of the core portion, the grip stop portion extending from an upper end of the cylindrically shaped interior portion;

a grip portion coupled to the core portion and increasing in diameter from a top end adjacent to the grip stop portion to a bottom end at an angle in the range of about 10 degrees to about 25 degrees, the grip portion defining a conical shape, a circumference of the grip portion at the bottom end defining a terminal surface of the anti-fatigue grip; and, a strap coupled to the grip stop portion.

10. The anti-fatigue grip of claim 9 wherein the grip portion further comprises a channel defining an indentation disposed upon a circumference of the grip portion and extending substantially the length of the grip portion in a spiral configuration.

11. The anti-fatigue grip of claim 9 further comprising a pole coupled to the interior portion of the core portion.

12. The anti-fatigue grip of claim 9 wherein the grip stop portion further comprises a core strap base aperture.

13. An anti-fatigue grip assembly comprising:

a core portion being made of a non-deformable material and having a cylindrically shaped interior portion and a grip stop portion, the cylindrically shaped interior portion having sidewalls defining a channel extending from an upper end to a lower end of the core portion, the grip stop portion extending from an upper end of the cylindrically shaped interior portion;

a grip portion coupled to the core portion and increasing in diameter from a top end adjacent to the grip stop portion to a bottom end at an angle in the range of about 10 degrees to about 25 degrees, the grip portion defining a conical shape, a circumference of the grip portion at the bottom end defining a terminal surface of the anti-fatigue grip;

a strap coupled to the grip stop portion; and, a pole coupled to the interior portion of the core portion at a terminal end of the pole.

14. The anti-fatigue grip assembly of claim 13 wherein the grip portion further comprises a channel defining an indentation disposed upon a circumference of the grip portion and extending substantially the length of the grip portion in a spiral configuration.

15. The anti-fatigue grip assembly of claim 13 further comprising a raised portion disposed upon a circumference of the grip portion and extending substantially the length of the grip portion in a spiral configuration.

16. The anti-fatigue grip assembly of claim 13 wherein the grip portion is constructed from a material selected from the group consisting of rubber, silicone, ethylene-vinyl acetate foam, and cork.

* * * * *